US005319428A

United States Patent [19]

Maruko et al.

[11] Patent Number: 5,319,428

[45] Date of Patent: Jun. 7, 1994

[54] COLOR IMAGE FORMING APPARATUS

[75] Inventors: Masami Maruko; Naoki Tajima, both of Hachioji, Japan

[73] Assignee: Konica Corporation, Tokyo, Japan

[21] Appl. No.: 969,468

[22] Filed: Oct. 30, 1992

[30] Foreign Application Priority Data

Nov. 21, 1991 [JP] Japan ..... 3-306356
Jul. 8, 1992 [JP] Japan ..... 4-181166

[51] Int. Cl.[5] ..... G03G 15/20

[52] U.S. Cl. ..... 355/290; 355/285; 355/289; 355/295; 219/216

[58] Field of Search ..... 355/285, 289, 282, 290, 355/295, 208, 203, 204; 219/216

[56] References Cited

U.S. PATENT DOCUMENTS

| | | | |
|---|---|---|---|
| 4,696,561 | 9/1987 | Katoh et al. | 219/216 X |
| 4,897,696 | 1/1990 | Matsumoto | 355/285 |
| 4,905,051 | 2/1990 | Satoh et al. | 355/290 |
| 4,951,096 | 8/1990 | Derimiggio et al. | 355/285 |
| 4,996,567 | 2/1991 | Watarai et al. | 355/290 |
| 5,001,519 | 3/1991 | Saito | 355/285 |
| 5,040,022 | 8/1991 | Kinoshita et al. | 355/285 X |
| 5,051,780 | 9/1991 | Stelter et al. | 355/208 |
| 5,073,799 | 12/1991 | Watanabe | 355/285 |
| 5,085,962 | 2/1992 | Aslam et al. | 355/285 X |
| 5,118,920 | 6/1992 | Tanabe et al. | 219/216 |
| 5,124,756 | 6/1992 | Stelter | 355/290 |
| 5,151,573 | 9/1992 | Masuda | 219/216 |
| 5,216,225 | 6/1993 | Muto et al. | 219/216 |
| 5,227,853 | 7/1993 | Proulx et al. | 355/282 |

*Primary Examiner*—Matthew S. Smith
*Attorney, Agent, or Firm*—Frishauf, Holtz, Goodman & Woodward

[57] ABSTRACT

In a color image forming apparatus provided with a fixing roller and a pressure roller equipped with a heater therein, which is in press contact with the fixing roller. The completion timing of warm-up of the fixing device is determined by the time at which either the detected temperature of the fixing roller or the heating time of the heater reaches a predetermined value.

4 Claims, 5 Drawing Sheets

| | SHEET | t (c) ° | t (B) ° | TEMP. DEFERENCE |
|---|---|---|---|---|
| NON-GLOSSY | NORMAL | 130 | 185 | 55° |
| | THICKER | 165 | 205 | 40° |
| GLOSSY | TRANSPARENCY | 150 | 185 | 35° |
| | NORMAL | 150 | 185 | 35° |
| | THICKER | 150 | 185 | 35° |

COLOR IMAGE FORMING APPARATUS

BACKGROUND OF THE INVENTION

The present invention relates to a color image forming apparatus provided with a heat roller type fixing device in which a fixing roller is heated when heat is supplied from a pressure roller.

In general, the heat roller type fixing device includes a fixing roller in which a heater is provided and a pressure roller, the circumferential surface of which is covered with heat-resistant rubber. However, the fixing device of the present invention includes a fixing roller having no heater, the circumference of which is covered with resilient heat-resistant rubber, and also includes a metallic pressure roller in which a heater is provided, wherein the fixing roller and pressure roller are combined to carry out a fixing operation. In this fixing device, toner on a transfer sheet is heated and fixed by the fixing roller heated by the action of the pressure roller having a heater.

When an electrical power switch of the image forming apparatus is turned on, the pressure roller is rotated and the heater is energized. When the temperature of the circumferential surface has reached a predetermined setting value $t_0$ as shown in FIG. 4(*a*), electrical power supply to the heater is repeatedly turned on and off so as to maintain setting temperature $t_0$.

On the other hand, the fixing roller receives heat from the circumferential surface of the pressure roller, and the circumferential temperature of the fixing roller is gradually raised as shown by a solid line in FIG. 4(*b*). When the temperature has been increased to the predetermined fixing temperature $t_1$, or $t_2$, a control section sends a signal of indicating a completion of the warming-up, and the apparatus displays a condition of ready-to-copy.

However, the result of detection by a temperature sensor to detect the circumferential temperature of the fixing roller fluctuates a little below the circumferential temperature of the fixing roller as shown by a broken line in FIG. 4(*b*) because the heat capacity of the temperature sensor affects the response of detection and the deviation of the detected temperature.

For example, in the case where transfer sheets are thin and relatively low fixing temperature $t_1$ is set as the circumferential temperature of the fixing roller, time lag $T_1$ caused by the temperature sensor is very small. However, in the case where transfer sheets are thick and high fixing temperature $t_2$ is set, time lag $T_2$ is considerable.

Fixing temperature to be set at the fixing roller depends on the thickness of a transfer sheet, the size of the transfer sheet, and the color of toner to be fixed, and further the fixing temperature depends on the required surface condition of an image, that is, whether the image is glossy or nonglossy. In the case where a high fixing temperature is set, an unnecessarily long period of time is required for warming-up, that is, a long period of time passes until ready-to-copy is displayed.

SUMMARY OF THE INVENTION

It is an object of the present invention to provide a color image forming apparatus in which the fixing temperature is controlled in accordance with the type of transfer sheet and a display of ready-to-copy is appropriately displayed.

The aforementioned object can be accomplished by the structure of the image forming apparatus of the invention provided with a fixing device including a fixing roller and a pressure roller in which a heater is installed, said pressure roller being contacted with said fixing roller with pressure, wherein the time of completion of warming-up of the fixing device is determined by the time at which the detected temperature of the fixing roller or the heating time of the heater reaches a predetermined value.

DETAILED DESCRIPTION OF THE PREFERRED EMBODIMENTS

An example of the color image forming apparatus of the present invention is shown in FIGS. 1 to 6.

Figure 1:
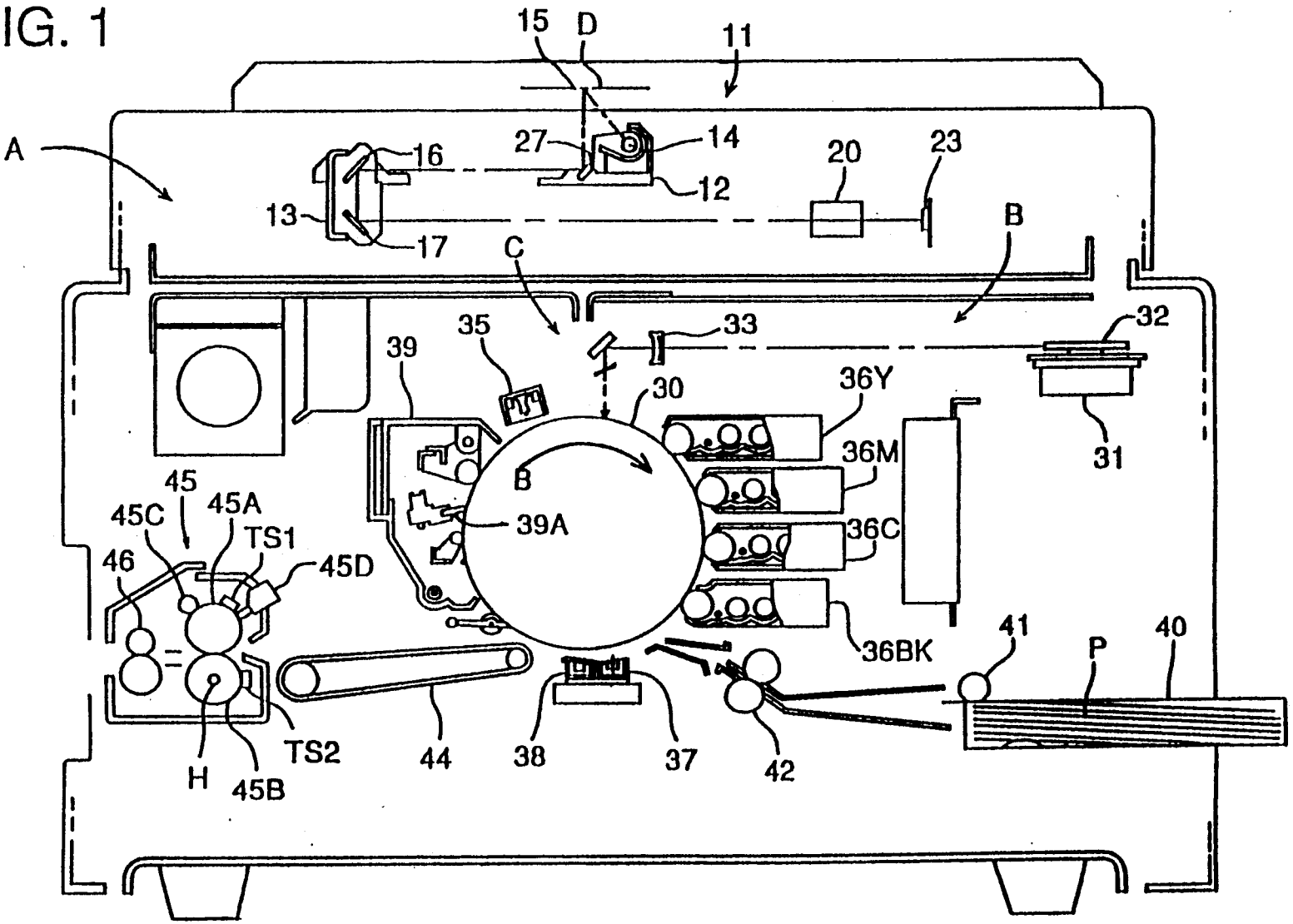
FIG. 1 is a sectional view showing the structure of a color image forming apparatus of the present invention.

FIG. 1 is a sectional view showing an example of the color image forming apparatus. This color image forming apparatus includes image reading system A, laser writing system B, and image forming section C.

A platen composed of a pane of transparent glass is provided on the upper portion of the image forming apparatus, and a document stack section 11 including a document cover for document D stacked on the platen is also provided on the upper portion of the image forming apparatus. Image reading system A including a first mirror unit 12, second mirror unit 13, primary lens 20 and color CCD 23 is provided inside the apparatus body in the lower portion of the platen. The first mirror unit 12 is provided with an exposure lamp 14 and a first mirror 15, and can be linearly moved in parallel with the platen in the lateral direction with respect to the drawing. The first mirror unit 12 optically scans the entire surface of document D. The second mirror unit 13 integrally includes a second mirror 16 and third mirror 17. In order to maintain a predetermined optical path length, the second mirror unit 13 is linearly moved in the same direction as the first mirror unit 12 at half speed. Of course, this second mirror unit 13 is moved in parallel with the platen in the same manner as the first mirror unit 12. An image of document D placed on the platen is exposed by the exposure lamp 14. The image is formed by the primary lens 20 on the color CCD 23 through the first mirror 15, second mirror 16 and third mirror 17. A scanning operation is described above. After the scanning operation has been completed, the first and second mirror units 12, 13 are returned to the initial positions, and wait for the next copying operation.

Image data of each color obtained by the color CCD 23 is electrically taken out and processed. The processed image data is outputted from the laser writing system B as an image signal.

Image forming section C includes a charger 35, image exposure section, developing units 36Y, 36M, 36C, 36BK, transfer unit 37, separator 38, and cleaning unit 39, which are disposed around a photoreceptor drum 30 on which images are formed. Image forming section C also includes a sheet supply cassette 40, conveyance belt 44, and fixing unit 45, which are disposed close to the photoreceptor drum 30.

The developing units 36Y, 36M, 36C, 36BK are disposed in the following manner. The developing unit 36Y is disposed in the most upstream portion around the photoreceptor drum 30, and the developing unit 36BK loaded with black toner BK is disposed in the most downstream portion. Conventional color toners are loaded in the developing units 36Y, 36M, 36C, and conventional black toner BK is loaded in developing unit 36BK, so that explanations are omitted here.

The above-described image forming apparatus is provided with two copy modes, one being a color image copy mode, and the other a monochromatic image copy mode. When an operator presses a button provided outside the apparatus, either of the two copy modes can be arbitrarily selected.

When the color copy mode is selected to copy a color image on document D, the copy button is pressed by an operator, and each process of image reading system A, laser writing system B and image forming section C is operated so that a color copy image can be formed. That is, the copy operation is started when an image signal sent from image reading system A is inputted by the control of the CPU into laser writing system B composed of a drive motor 31, polygonal mirror 32, a semiconductor laser not shown, fθ lens 33, and a correction lens. That is, the photoreceptor drum 30 is rotated clockwise in the arrowed direction B and a uniform electrical charge is given by the charger 35. Then, in the image exposure section, a yellow (Y) image corresponding to the image of document D is written by laser writing system B, so that an electrostatic latent image corresponding to the yellow image can be formed. This electrostatic latent image on the photoreceptor drum 30 is developed in the manner of reversal-development by the developing unit 36Y loaded with Y toner, and a visual Y toner image can be formed. A DC voltage and further an AC bias voltage is impressed upon a developing sleeve in which a magnetic roller is provided, and noncontact development is conducted on the electrostatic latent image by a two-component developer to form a Y toner image. The photoreceptor drum 30 on which the Y toner image is formed passes under the cleaning unit 39 that has been withdrawn from the surface of the photoreceptor drum 30, and the photoreceptor drum 30 enters the second rotation. Then, the photoreceptor drum 30 is electrically charged by the charger 35, and a magenta image is written by laser writing system B. Accordingly, an electrostatic latent image of magenta (M) is formed on the aforementioned Y toner image. This latent image is developed in the manner of reversal-development by the developing unit 36M loaded with magenta toner. In the same manner as described above, toner images of cyan (C) and black (BK) are successively superimposed.

On the other hand, when the monochromatic copy mode is selected in the case of a monochromatic image, a uniform electrical charge is given onto the photoreceptor drum 30 by the charger 35. Then, a scanning operation is carried out by laser writing system B using a laser beam for monochromatic use so that a monochromatic latent image is formed. Only the developing unit 36BK is operated to form a BK toner image without impressing a bias voltage upon the developing units 36Y, 36M and 36C.

Then, transfer sheet P conveyed out from the sheet cassette 40 by the sheet supply roller 41 one by one is sent onto the photoreceptor drum 30 by the timing roller 42 operated synchronously with the formation of the toner image. The toner image on the photoreceptor drum 30 is transferred onto transfer sheet P by the action of the transfer unit 37. Then, the transfer sheet is separated from the surface of the photoreceptor drum 30, and conveyed face-up to the fixing unit 45 through the conveyance belt 44.

After the image has been fixed on transfer sheet P by the fixing unit 45, transfer sheet P is discharged outside by the discharge roller 46. The photoreceptor drum 30 is continuously rotated, and the residual toner on the photoreceptor surface is cleaned by the cleaning unit 39, the cleaning blade 39A of which has been released from the withdrawal condition. In this way, the apparatus waits for the next copying operation.

The aforementioned fixing unit 45 is a heat roller type fixing unit including a rotatable fixing roller 45A, the surface of which is covered with heat-resistant rubber, and a pressure roller 45B that is contacted with the fixing roller 45A so as to be idly rotated, wherein heater H is provided in the pressure roller 45B.

Temperature of the circumferential surface of the fixing roller 45A is detected by temperature sensor TSI contacted with the surface of the fixing roller 45A, and temperature of the circumferential surface of the pressure roller 45B is detected by temperature sensor TS2 contacted with the surface of the pressure roller 45B. According to the result of the measurement, the fixing unit 45 is controlled to a predetermined fixing temperature. The surface of the fixing roller 45A is cleaned by a cleaning roller 45C at each revolution, and then the surface is coated with oil by an oil supply unit 45D in order to improve the releasing property, so that transfer sheet P can be easily separated from the fixing roller surface after transfer.

When transfer sheet P, on which a toner image has been transferred, is conveyed into the fixing unit 45 through the conveyance belt 44, the toner is fused by the heat and pressure of the fixing roller 45A, so that the toner image is fixed onto transfer sheet P.

Figure 2:
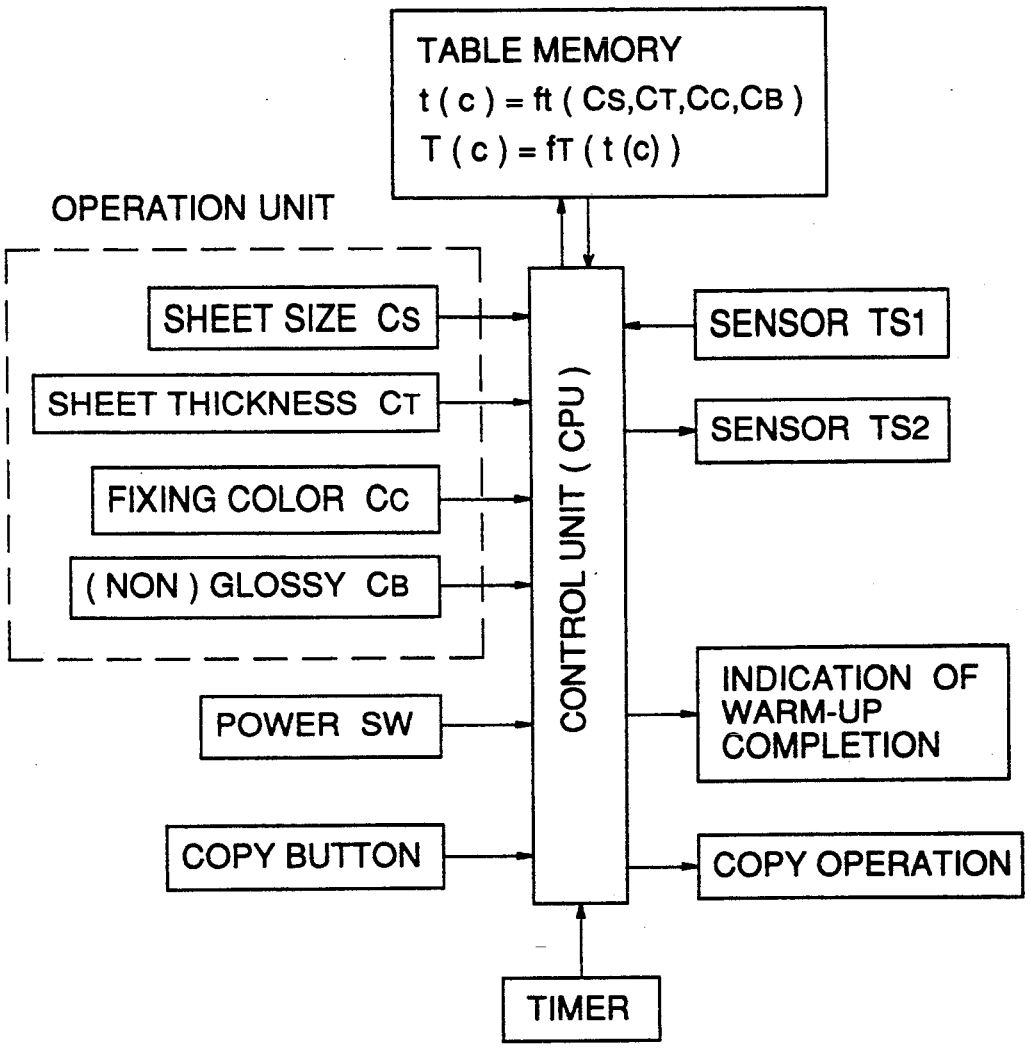
FIG. 2 is a block diagram for fixing temperature control of a fixing device.
Figure 3:
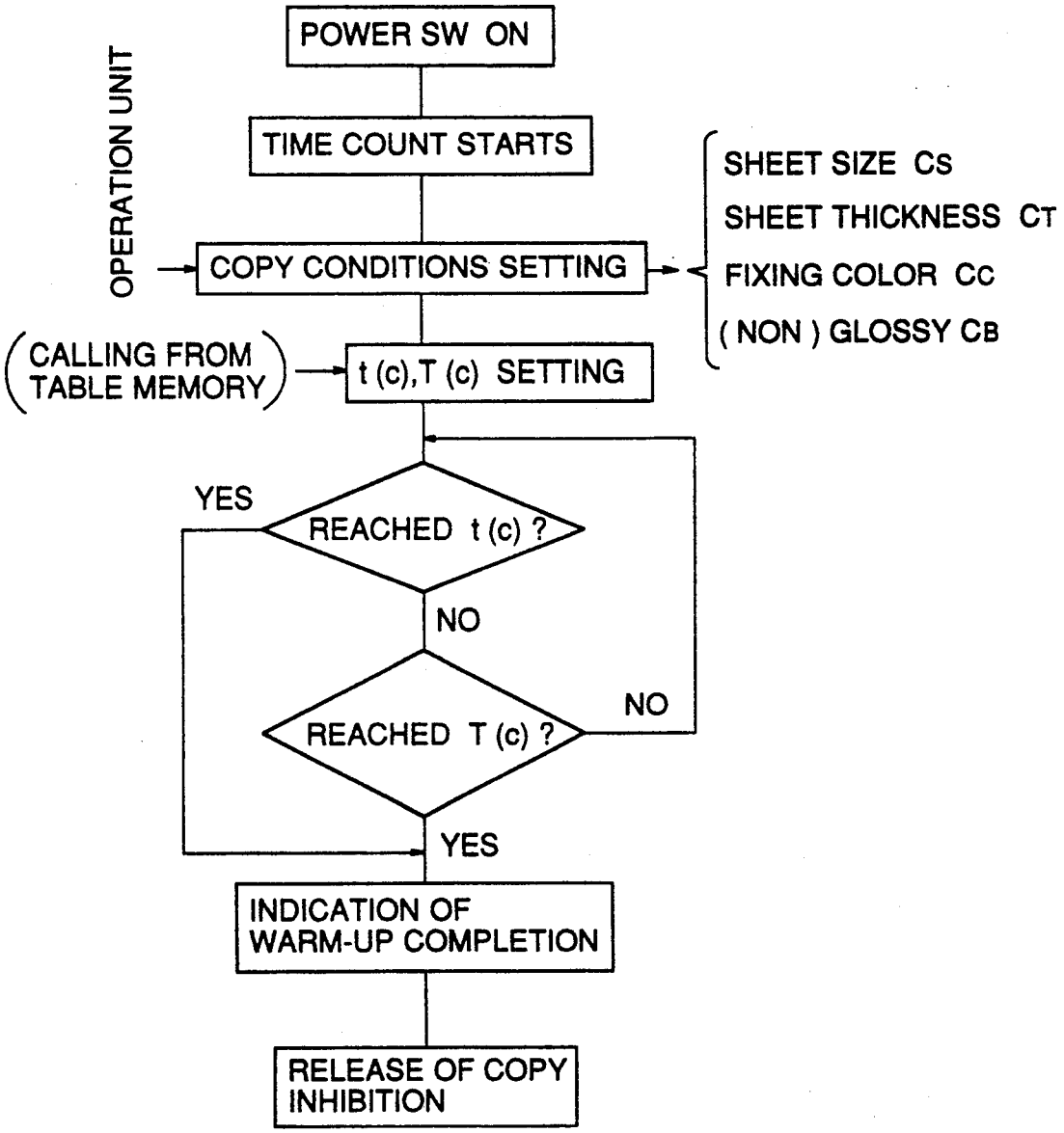
FIG. 3 is a flow chart for fixing control.

An indication that the fixing unit has reached the predetermined fixing temperature, that is, an indication expressing a state of ready-to-copy, is shown by the control circuit in FIG. 2 and the flow chart in FIG. 3 according to the detection of the temperature of the fixing roller 45A, or the detection of the period of time that has passed after electrical power switch SW was turned on.

Selection buttons to select various fixing conditions described later are provided in the operating section of the image forming apparatus. In this case, the fixing conditions are as follows: material ($C_M$) of transfer sheet P, size ($C_S$), thickness ($C_T$), color ($C_C$) of toner to be fixed, and the surface condition ($C_B$), i.e. a glossy surface or a nonglossy surface.

Previously inputted into the control section are setting temperature t(C) of the fixing roller 45A corresponding to the aforementioned conditions, and time T(C) from when the electrical power source is turned on to when the temperature reaches setting temperature t(C), time T(C) being experimentally found beforehand, wherein t(C) and T(C) are previously inputted in the form of a table memory. In this case, t(C) and T(C) are expressed as follows.

$$t(C)=f_t(C_S, C_T, C_C, C_B)$$

$$T(C)=f_T(t(C))$$

When a selection button is pressed on the operation panel, the processing condition can be set, and setting temperature t(C) and setting time T(C) are called from the table memory and set in the apparatus.

When electrical power switch SW is turned on, time measurement is started. As shown in FIG. 3, the control section checks whether or not the temperature has reached setting temperature t(C), and further checks whether or not the period of time has reached setting time T(C). At a point of time when the temperature corresponding to fixing condition t(C) or the time corresponding to fixing condition T(C) has been detected, the indication of a state of ready-to-copy is shown.

For example, when transfer sheet P, which is a thin ordinary paper of a small size on which a black toner image is formed, is to be fixed with a nonglossy finish, the circumferential surface temperature of the fixing roller 45A is set at 130° C., which is relatively low. Therefore, as shown in the example shown in FIG. 4(*b*) in which the circumferential surface temperature is $t_1$, time lag of temperature detection by temperature sensor TS is so short that it can be neglected. For that reason, in general, the time of a state of ready-to-copy can be detected by the result of detection of setting temperature t(C) that has been previously set.

On the other hand, when transfer sheet P, which is a thick paper of a large size on which a color toner image is formed, is to be fixed with a glossy finish, the circumferential surface temperature of the fixing roller 45A is set at 150° C. to 160° C., which is relatively high. Therefore, as shown in the example shown in FIG. 4(*b*) in which the circumferential surface temperature is $t_2$, a large time lag $T_2$ is caused. For that reason, the time of a state of ready-to-copy can be determined according to the result of time detection. In this case, setting time T(C) is set at $T_m$, which is a little longer than the time required for raising the surface temperature of the fixing roller 45A.

Figure 4A:
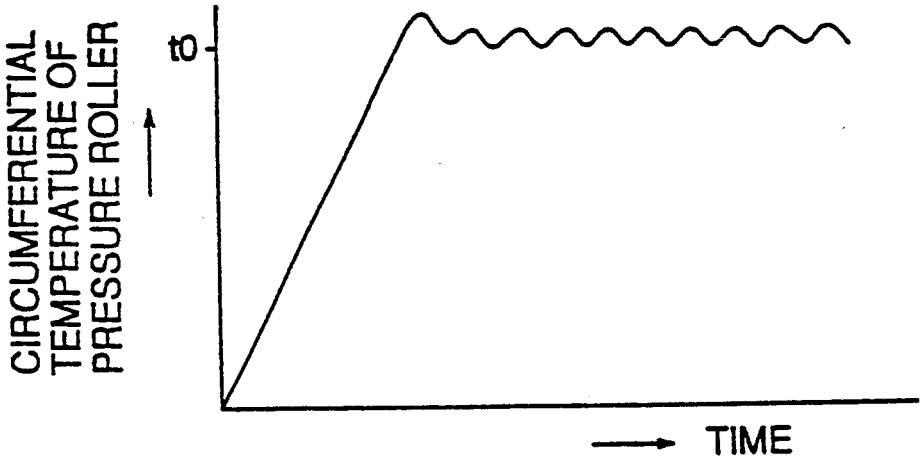
FIGS. 4(*a*) and 4(*b*) are graphs showing a change in temperature of each roller of a fixing device.
Figure 4B:
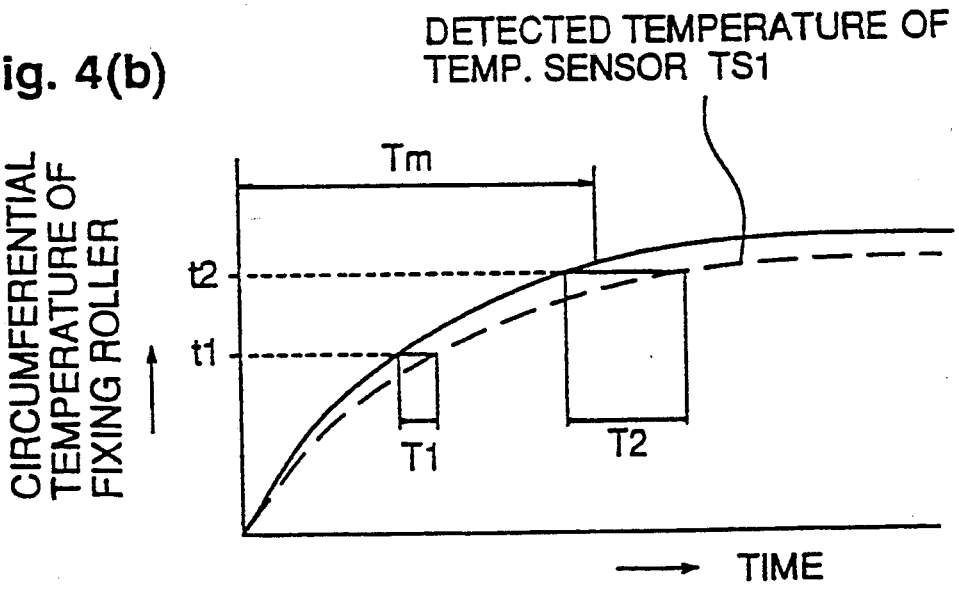

Circumferential surface temperature $t_O$ of the pressure roller 45B shown in FIG. 4(*a*) is generally set at 190° C. In accordance with the result of selection of the fixing conditions, the circumferential surface temperature of the fixing roller 45A is changed and circumferential surface temperature $t_0$ is automatically changed.

Circumferential surface temperature $t_0$ of the pressure roller 45B is changed in accordance with the setting circumferential surface temperature of the fixing roller 45A. Even after that, when the circumferential surface temperature of the fixing roller 45A is raised to a temperature higher than a critical temperature that has been previously set, the heating operation conducted by the pressure roller 45B is temporarily stopped, and the circumferential surface temperature of the fixing roller 45A is controlled so that it can be always maintained at a prescribed temperature.

Figures 5, 6:
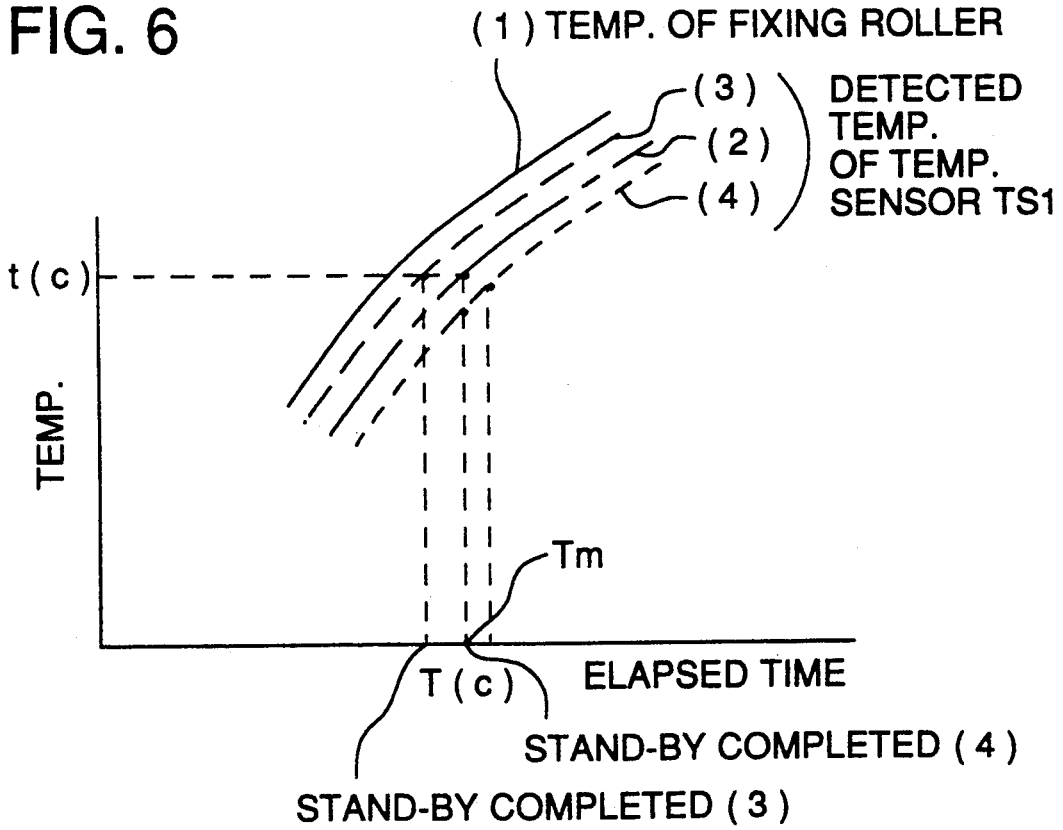
FIG. 5 is a table showing setting temperatures under various conditions.
FIG. 6 is a graph showing a relation between the fixing roller temperature and the elapsed time.

FIG. 5 shows an example of those setting conditions. FIG. 5 shows the most appropriate setting temperature in the case where toner images formed on various kinds of transfer sheets are fixed with a glossy surface or nonglossy surface. In this case, t(C). is the setting temperature of the fixing roller 45A detected by temperature sensor $TS_1$, and t(B). is the setting temperature of the pressure roller 45B detected by temperature sensor $TS_2$. In order to maintain the temperature at the aforementioned setting value, heater H is controlled for heating, and further a fan is preferably used for cooling.

The control section is previously inputted with setting temperature t(C) of the fixing roller 45A corresponding to the aforementioned conditions, and time T(C) from when the electrical power source is turned on to when the temperature reaches setting temperature t(C), time T(C) being experimentally found beforehand, wherein t(C) and T(C) are previously inputted in the form of a table memory. In this case, t(C) and T(C) are expressed as follows.

$$t(C)=f_t(C_H, C_S, C_T, C_C, C_B)$$

$$T(C)=f_T(t(C))$$

When a selection button is pressed on an operation panel, the processing condition for a state of ready-to-copy can be set, and setting temperature t(C) and setting time T(C) are called from the table memory and set in the apparatus.

The aforementioned relation is generally illustrated in FIG. 6, wherein the horizontal axis expresses the elapsed time, and the vertical axis expresses the increased temperature. Curve (1) is a substantial temperature curve of the fixing roller 45A from when electrical power switch SW has been turned on. Curve (2) is a standard detected temperature curve (setting value) detected by temperature sensor $TS_1$ when the temperature of the fixing roller 45A is raised along curve (1). Curves (3) and (4) are examples of curves of temperature substantially detected by the temperature sensors. If we take for an example a case in which the setting temperature is set at $t_c$, and the setting time is set at $T_m(T(C)+\Delta T)$ so as to set the ready-to-copy conditions, even when the electrical power source is turned on, the detected temperature curve does not necessarily coincide with curve (2) due to the influence of environmental temperature. For that reason, the temperature is raised along curve (3) or (4). In the case where the temperature is raised along curve (3), a point of time when the temperature has reached setting temperature t(C) is the time at which a state of ready-to-copy is reached (3). In the case where the temperature is raised along curve (4), a point of time when the temperature has passed through setting time $T_m$ is the time at which a state of ready-to-copy is reached (4).

What is claimed is:

1. A color image forming apparatus comprising:

fixing means including:

a single heater-less fixing roller; and a single pressure roller including a heater, for directly heating said pressure roller, said pressure roller being in pressure contact with said heater-less fixing roller for pressing against and transmitting heat only in a direction toward said heater-less fixing roller, such that said heater indirectly heats said fixing roller via said pressure roller;

a detector for detecting a temperature of a circumferential surface of said heater-less fixing roller;

clock means for counting a period of time during which said heater is directly heating said pressure roller and indirectly heating said heater-less fixing roller; and control means for controlling a completion of a warm-up of said fixing means so that said completion of said warm-up is set when one of a detected temperature of said heater-less fixing roller detected by said detector reaches a predetermined temperature and when the counted period of time reaches a predetermined period of time.

2. The apparatus of claim 1, wherein said control means controls one of a predetermined temperature and a predetermined period of time according to a size of a recording sheet to be used and a color of a toner to be fixed by said fixing means.

3. The apparatus of claim 1, wherein said control means controls a temperature on a circumferential surface of said pressure roller according to a size of a recording sheet to be used and a color of a toner to be fixed by said fixing means.

4. The apparatus of claim 1, wherein said control means controls said heater to lower a circumferential surface temperature of said pressure roller when the detected temperature of said heater-less fixing roller exceeds the predetermined temperature to thereby indirectly lower the detected temperature of said heater-less fixing roller.

* * * * *